US005277558A

United States Patent [19]

Long

[11] Patent Number: 5,277,558

[45] Date of Patent: Jan. 11, 1994

[54] CONSTANT OUTPUT PRESSURE PUMP

[76] Inventor: Marshall Long, 11147 Old Harbour Rd., North Palm Beach, Fla. 33408

[21] Appl. No.: 912,300

[22] Filed: Jul. 13, 1992

[51] Int. Cl.[5] ..... F04C 21/00

[52] U.S. Cl. ..... 417/481; 417/519; 417/900

[58] Field of Search ..... 417/481, 482, 518, 519, 417/900

[56] References Cited

U.S. PATENT DOCUMENTS

| | | | |
|---|---|---|---|
| 1,591,313 | 7/1926 | Holland | 417/481 |
| 4,131,394 | 12/1978 | Sjöblom | 417/481 |
| 4,193,743 | 3/1980 | Bille | 417/519 |
| 4,863,317 | 9/1989 | Boyle | 417/519 |
| 5,106,272 | 4/1992 | Oakley et al. | 417/347 |

*Primary Examiner*—Richard A. Bertsch
*Assistant Examiner*—Charles G. Freay
*Attorney, Agent, or Firm*—Kokjer, Kircher, Bowman & Johnson

[57] ABSTRACT

A conveyance pump having a substantially constant output pressure. The pump includes a chamber having a circular periphery. A vane is mounted within the pump chamber for oscillation through an arc and a valve chamber includes opening to each boundary of this arc, and with input and output conduits. Within the valve chamber is a valve which may move between two positions, allowing communication between alternate pairs of openings and conduits. An hydraulic motor is connected to the vane to cause its oscillation between the limit positions, and a motor rotates the valve between its positions. In operation the vane will rotate, drawing material from the input opening into the pump chamber behind the advancing vane, and pushing, and thus pressurizing, the material out of the pump chamber in front of the advancing vane and out of the output opening. Reversing the vane continues this process. If a product flow stoppage occurs downstream of the pump the output pressure on the vane will exceed the pressure generated by the hydraulic motor, thus causing the vane to automatically stop oscillation. When the downstream stoppage has been removed, the output pressure will begin to lower, and the vane will again automatically resume oscillation.

10 Claims, 2 Drawing Sheets

CONSTANT OUTPUT PRESSURE PUMP

BACKGROUND OF THE INVENTION

1. Field of the Invention

The present invention relates in general to pumps for material conveyance. In particular, the present invention relates to an improved conveyance pump providing a substantially constant output pressure.

2. Description of the Related Art

For the conveyance of flowable materials, such as granular material, liquid material, and liquid material containing solid elements, and gasses, it is know to provide various pump arrangements. One typical example is the use of a rotating auger within an exterior sleeve. A feed hopper or input pipe leads to a first end of the auger sleeve, and the rotating helical lands of the auger move the material to the second end of the sleeve to an exit opening. The constantly rotating auger may thus be employed to maintain a pressure upon the output flow, assuming there is some restriction upon the output flow downstream of the auger exit.

Such pressurization is employed in many fields of endeavor, including the production of food for human consumption. For example, solid food bits, such as cut carrots or other material, may be conveyed with a certain amount of water and steam at high pressure to effect sterilization of the food items. It is important to maintain the pressure on the product to ensure penetration of the steam and full sterilization.

However, it is often the case that such an auger pump will be employed to provide a pressurized flow to a downstream operation which is not entirely continuous. For example, there may be occasional product flow stoppages due to an intermittent downstream process, jamming of the product within the output conduit, etc. While the downstream flow of the product may be interrupted, the auger pump continues to operate, forcing additional product into the output conduit, thus raising the pressure within the output conduit.

For those situations or processes where a constant output pressure, or at least a maximum desired output pressure, are desired, it would be necessary to place a pressure sensor within the output conduit and have this pressure sensor operatively connected to the control system of the auger. Such an arrangement is expensive, not particularly reliable, and provides pressure fluctuations within the output conduit.

SUMMARY OF THE INVENTION

An object of the present invention is to provide a conveyance pump which will reliably convey material.

Another object is to provide such a pump which will provide a substantially constant output pressure upon the conveyed material.

Another object of the present invention is to provide such an output pump which will automatically cease operation if the output pressure exceeds a predetermined limit, and automatically restart operation when the product pressure falls below this upper limit.

Yet another object is to employ such a pump in a process of sterilizing food for human consumption.

These and other objects are achieved by a conveyance pump having a substantially constant output pressure. The pump includes a pump chamber having a substantially circular periphery defining a longitudinal axis. A vane is mounted within the pump chamber for oscillation through an arc bounded by two limit positions. The vane includes appropriate seals with the interior of the pump chamber such that the vane may act as a pressure barrier. In the area of the chamber not encompassed within the arc of the vane, there is formed a valve chamber in communication with each of the boundaries of this arc, and with the input and output conduits for the pump. Within the valve chamber is a valve which may move between two positions, the first of which opens communication between the input opening and a first of the boundaries of the arc and between a second of the boundaries of the arc and the output opening, and a second position opening communication between the input opening and the second boundary of the arc and between the first boundary of the arc and the output opening. A hydraulic motor is connected to the vane to cause its oscillation between the limit positions, and a hydraulic motor is connected to the valve to rotate it between its first and second positions. In operation the vane will rotate from a first of the limit positions to a second of the limit positions, drawing material from the input opening into the pump chamber behind the advancing vane, and pushing, and thus pressurizing, the material out of the pump chamber in front of the advancing vane and out of the output opening. When the vane reaches the second limit position the valve will rotate to its second position, and the vane will oscillate back towards the first limit position, drawing in additional material and pushing out the material previously drawn in. If a product flow stoppage occurs downstream of the pump the output pressure in the output opening, and thus on one side of the vane will begin to increase. However, this pressure will exceed the pressure generated by the hydraulic motor, thus causing the vane to automatically stop oscillation. When the downstream stoppage has been removed, the output pressure will begin to lower, and the vane will again automatically resume oscillation.

BRIEF DESCRIPTION OF THE DRAWINGS

The objects and features of the invention noted above are explained in more detail with reference to the drawings in which like reference numerals denote like elements, and in which.

DETAILED DESCRIPTION OF THE INVENTION

Figure 2:
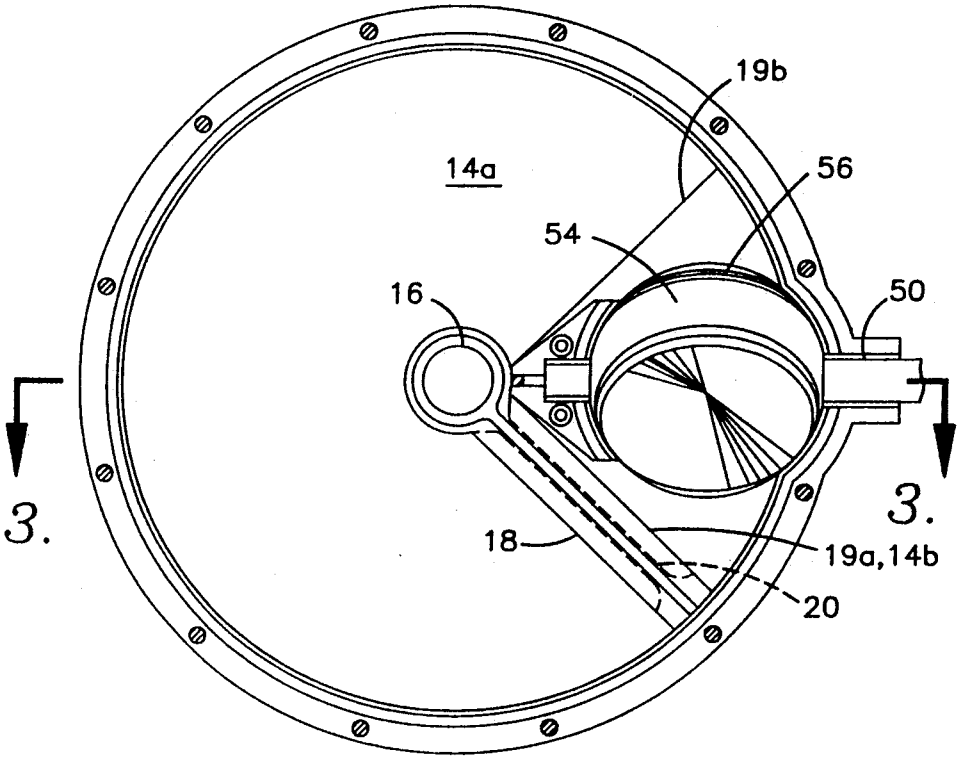
FIG. 2 is a top view of the pump of FIG. 1 with portions removed to view the interior.
Figure 1:
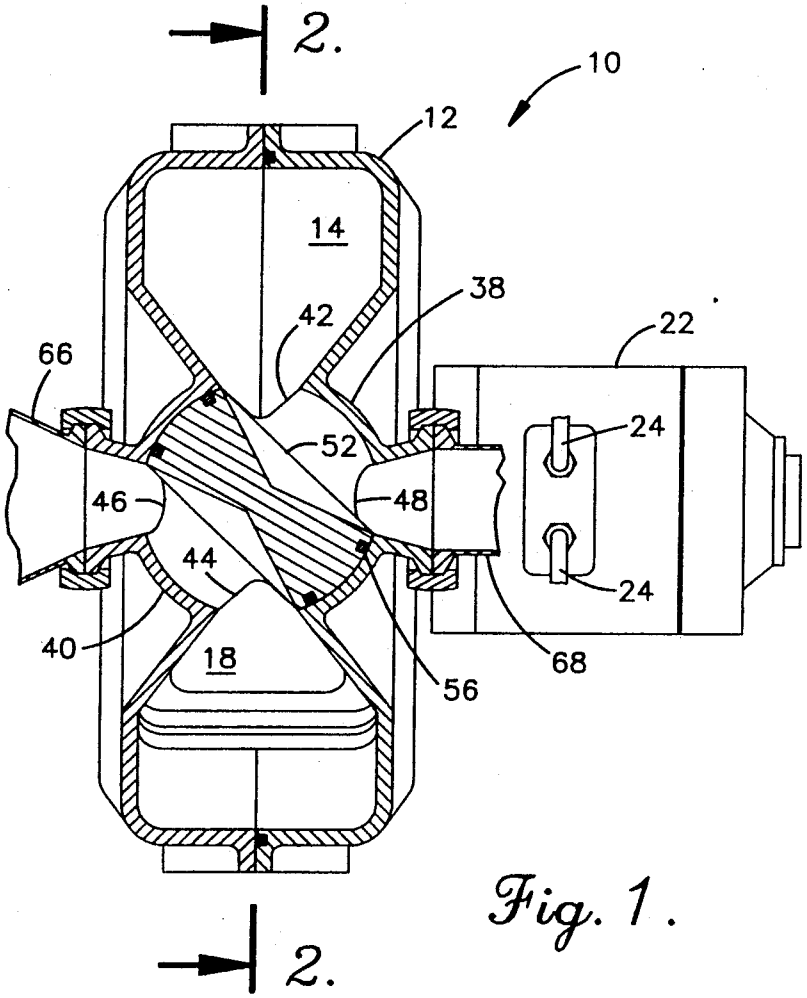
FIG. 1 is a front view of a pump according to the present invention and partial cross-section.

With reference to the drawings and FIG. 1 in particular, a pump according to the present invention is generally designated by reference numeral 10. The pump includes an outer casing 12 defining an interior cavity 14. The outer casing is formed of a material which may withstand the pressures generated by the pump. As is best shown in FIG. 2, the outer periphery of the interior cavity 14 is substantially circular, and defines a longitudinal axis perpendicular to this periphery.

A drive shaft 16 extends through the interior cavity 14 substantially coincident to the longitudinal axis and is mounted in appropriate bearings in the outer casing on each side of the interior cavity. Fixed to the drive shaft is a radially extending vane 18. The vane 18 has an outer periphery in the plane of the longitudinal axis and which substantially conforms to the configuration of the interior cavity. As such, vane 18 serves to partition the cavity into two subcavities 14*a* and 14*b*, and acts as a product and pressure barrier. Appropriate seals 20 may be provided on the outer periphery of the vane 18 to assist in this function.

The pump also includes means to move the vane, which preferably comprise a hydraulic motor 22 fixed to the outer casing 12 and operatively connected to drive shaft 16 for powered rotation thereof. Motor 22 includes a pair of pressure lines 24 which supply pressurized hydraulic fluid from a pressurized hydraulic source 25 to cause rotation of the shaft 16. The motor 22 will allow rotation of the shaft in two directions, depending upon which of the lines 24 is pressurized. The lines 24 may be connected to a main pressure line 26 by a main switching valve 28 which allows the pressurized hydraulic fluid to be applied to one or the other of the lines 24, while the remaining line bleeds hydraulic fluid to a reservoir of supply 25, as in known in the art.

Motor 22 additionally includes a rotation sensor 30 which senses the position of the drive shaft 16. The sensor 30 is operatively connected to the switching valve 28, such that the position of the switching valve is controlled based upon the rotational position of drive shaft 16. For example, the rotation sensor 30 may include a mechanical coupling to the drive shaft 16 with this mechanical coupling switching a valve (not shown) within the sensor at desired rotational positions of the shaft. The valve within the sensor may control the flow of hydraulic fluid through switching lines 32 connected to the switching valve 28, such that the pressurized fluid within the switching lines will shift the position of the switching valve as desired. Alternatively, various electromechanical or other means could be employed for the sensor 30 and operative connection between the sensor 30 and switching valve 28.

In the embodiment shown the sensor 30 is set such that the vane 18 will oscillate within the cavity 14 through an arc less than 360 degrees. As such, the vane has first and second limit than 360 degrees. As such, the vane has first and second limit positions 34 and 36 between which it oscillates.

Located outside the extent of travel of the vane 18 is a main valve assembly, generally designated by reference numeral 38. In the present embodiment the main valve assembly includes a substantially spherical valve chamber 40 formed as a part of the outer casing 12. Valve chamber 40 communicates directly with interior cavity 14 by means of first and second cavity openings 42 and 44. As is best seen from comparison of FIGS. 1 and 3, the cavity openings are located in substantially opposed relation on the spherical valve chamber. Additionally, while each of the openings 42 and 44 open to the interior cavity 14, the presence of vane 18 ensures that these cavities are not in communication with each other through the interior cavity 14, and in fact the first opening 42 will open onto subcavity 14*a* while the second opening 44 will open onto subcavity 14*b*.

The valve chamber 40 also includes an inlet opening 46 and an outlet opening 48. The inlet and outlet openings are substantially opposed, and each of the openings 46 and 48 is located intermediate the first and second cavity openings. Therefore, as is best shown in FIG. 1, each of the openings are located at approximately 90 degree intervals, with sections of the spherical wall of valve chamber 40 interposed therebetween.

Figure 3:
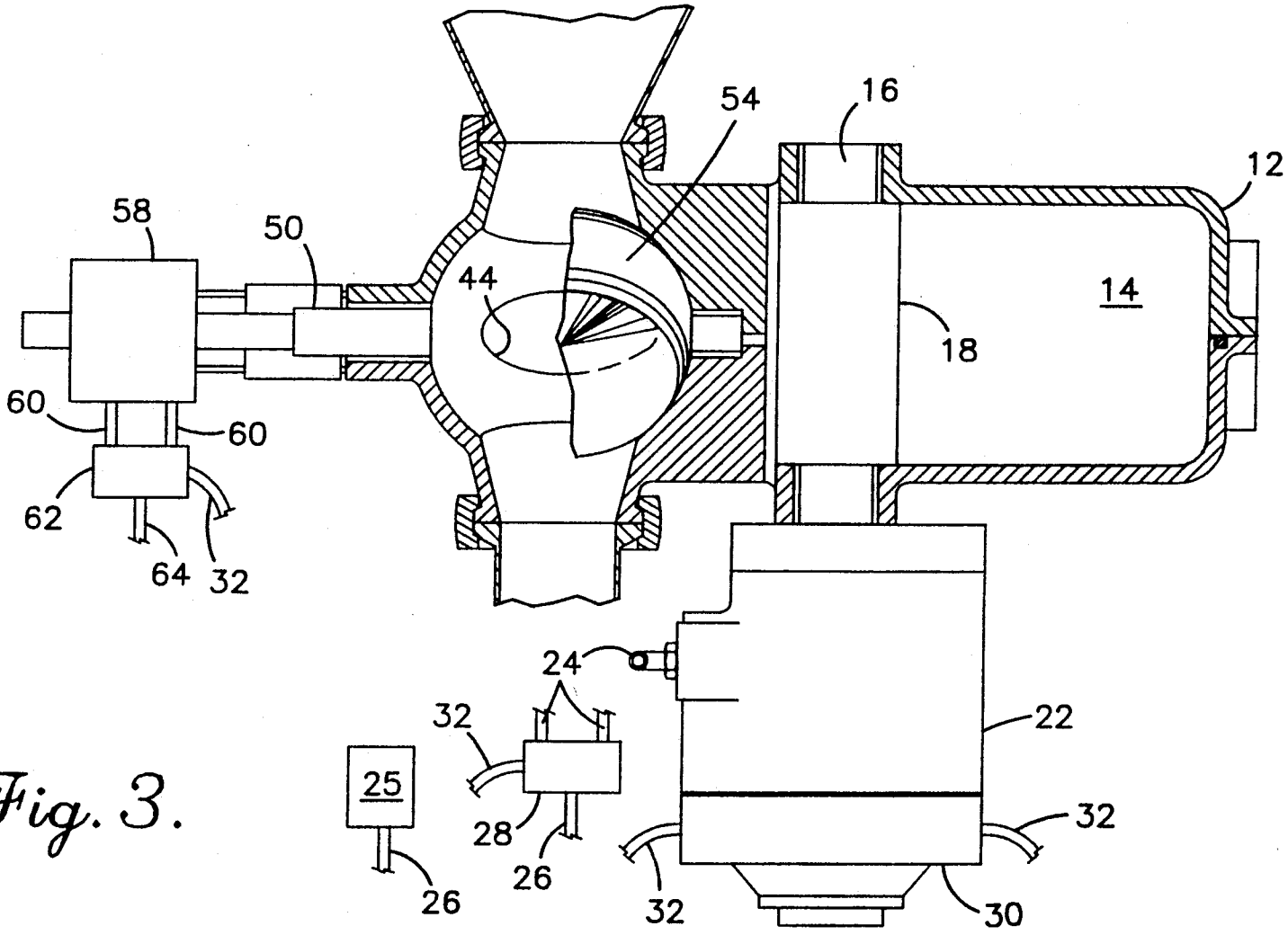
FIGS. 3 is a side view of the pump of FIG. 1 and partial cross-section.

A valve pivot rod 50 extends radially outward from the drive shaft 16 and through the center of the spherical valve chamber 40. The valve pivot rod is rotatably mounted on radially inner and outer sides of the valve chamber and serves to mount a valve element 52. Valve element 52 takes the general form of a disk having a peripheral face 54 formed as a section of a sphere, such that the peripheral face 54 is in close sliding contact with the interior of the spherical valve chamber 40. Peripheral seals 56 may be located in the peripheral face 54 to provide sealing contact with the interior of the valve chamber. As is best shown in FIGS. 1 and 3, the openings 42–48 are located radially about the longitudinal, and rotational, axis of pivot rod 50. Additionally, it is noted that the arcuate extent of the openings and the peripheral face 54 of valve element 52 ar sized such that rotation of the valve element 52 may fully open the openings 42–48, and may alternatively fully close the cavity openings 42 and 44.

In particular, in the position of FIG. 1 the peripheral face 54 corresponds to the angular extent of the wall of valve chamber 40 extending between the openings 42–48. However, if the valve element 52 of FIG. 1 were rotated 45° clockwise to extend substantially vertical (with respect to FIG. 1), the peripheral face of the valve element 52 would fully close the openings 42 and 44, preferably with the seals 56 being exterior to the periphery of the openings 42 and 44 to improve the closure of these openings.

The exterior faces of valve element 52 which extend between the peripheral face 54 are formed with a concave configuration such that the central portion of the valve element has a reduced thickness compared to the peripheral face 54. The reason for this concave configuration will be made clear below.

A valve motor 58 is fixed to the outer casing 12 and operatively connected to the valve pivot rod 50 for rotation of such rod. In the embodiment shown the motor 58 is formed as a hydraulic motor, and includes appropriate hydraulic lines 60 for supplying fluid to the motor. The lines 60 are in communication with a valve switching valve 62 which will alternately connect one or the other of the lines 60 with a main hydraulic fluid supply line 64.

The switching valve 62 may be controlled by hydraulic fluid, and in particular, the switching valve 62 is controlled by the rotation sensor 30 of motor 22. As such, the switching valve 62 may be operatively connected to the switching lines 32 of sensor 30. As above, the switching valve 62 could take other configurations, such as an electromechanical switch valve. Also as with the switching arrangement discussed above, the switching valve 62 will be controlled by the sensor 30 to cause oscillation of the valve element 52 between first and second positions.

The operation of the device will now be described.

As is best shown in FIG. 1, the outer casing 12 will be operatively connected within a conveyor system, such that the inlet opening 46 is in communication with a supply conduit 66, and the outlet opening 48 is in communication with a pressure conduit 68. The conduits 66 and 68 may take any configuration standard in the art, such as typical pipe lines. Alternatively, the supply conduit 66 could be formed as a simple hopper which receives bulk batches of the material to be conveyed. It is preferred that the conduit 66 be a pipe carrying solid food items with water and steam maintained at a high temperature and pressure for sterilization.

The pressure conduit 68 will be connected to further conveying or processing apparatus downstream of the pump 10. These downstream apparatus will preferably provide a restriction upon product flow, such that the material within pressure conduit 68 may be subjected to pressure, typically greater than that of atmospheric pressure.

For the purposes of description it may be assumed that the pump 10 is in the position of FIGS. 1 and 2 initially, with the material to be conveyed being made available to the pump 10 by the supply conduit 66. Initially, hydraulic pressure is applied to the main lines 26 and 64 to power the motors 22 and 58. At this initial position, the switching valve 62 is in a closed position such that no hydraulic fluid flows through the lines 60, and the valve element 52 thus remains stationary in the position of FIG. 1. The hydraulic fluid does, however, flow through the main switching valve 28 through the appropriate conduit 24 to effect counter clockwise rotation of the vane 18 as viewed in FIG. 2. Where the pump 10 has been oriented such that the supply conduit and inlet opening 46 are vertically uppermost, the material to be conveyed may pass freely by gravity through the inlet opening 46, between the valve element 52 and exterior wall of valve chamber 40, through the second cavity opening 44 and into the interior cavity 14.

In any event, rotation of the valve 18 will cause an increase in the volume behind the vane 18, such that the material to be conveyed is drawn through the inlet opening 46 and second cavity opening 44 into the interior cavity 14. This process will continue, with more and more material drawn into the interior cavity behind the advancing vane 18 until the vane 18 reaches second limit position **19*b*. At this point the sensor 30 is activated, causing pressurized fluid to flow through appropriate ones of the lines 32 to cause the main switching valve 28 to move to its second position, thus reversing the direction of rotation of vane 18. Simultaneously, the valve switching valve 62 is temporarily moved to a position in which hydraulic fluid may flow through the lines 60 and operate motor 58 to rotate the pivot rod 50 and valve element 52 90° clockwise as seen in FIG. 1**.

During the rotation of the valve element, the peripheral face 54 will fully seal the cavity openings 42 and 44 at the mid point of rotation such that the outlet opening 48 is essentially isolated. It is preferred that stoppage and reversal of the vane occur while the outlet opening is sealed, as this will ensure that the full pressure of the vane remains applied to the product. At this time the vane will begin counter clockwise rotation, causing the material within cavity 14 to be pressurized. To further ensure a constant pressure, it is preferred that the vane be allowed to build up to the proper pressure prior to the valve element uncovering the cavity opening.

One advantage to using a hydraulic motor for motor 22 is that the pressure generated within the closed portion of the interior cavity cannot exceed the pressure which may be generated by the hydraulic motor. As such, by proper adjustment of the supply pressure to hydraulic motor 22, the proper pressure may be reached within the interior cavity 14 prior to uncovering the opening, and the vane thereafter stop rotating, such that an overpressure situation can not occur.

With continued clockwise rotation of the valve element 52 the second cavity opening 44 will be placed in communication with the outlet opening 48. Where the supply pressure to motor 22 has been properly adjusted, the pressure within that portion of the cavity communicating with second opening 44 will be equal to the pressure within the pressure conduit 68, such that there are no pressure fluctuations in conduit 68. Since the vane is in a pressure equilibrium it will not move until the pressure in the conduit 68 falls incrementally below the pressure applied by the vane.

At this same time the inlet opening 46 is placed in communication with the first cavity opening 42, and with the subcavity **14*a* behind advancing vane 18. A slight continued rotation of the valve element 52 will place it in a position with the peripheral face 54** being aligned with the interior of the outer wall of the valve chamber and the openings in full communication.

At this point the rotation of the valve element 52 is halted by the switching valve 62 being placed in a closed configuration to halt flow of fluid through the lines 60 The motor 22, however, continues to operate and thus the vane 18 continues to advance counter clockwise. This counter clockwise rotation will force the material previously drawn into the subcavity **14*b* out through the second opening 44 and outlet opening 48 into the pressure conduit 68. Simultaneously, new material to be conveyed will be drawn through the inlet opening 46 and first cavity opening 42 into the subcavity 14*a* behind the advancing vane 18. As may be envisioned, the concave configuration of the exterior faces of valve element 52** increase the size of the passage formed between the various openings, producing very little pressure drop through this area.

Continued rotation of vane 18 will cause continued feeding of material into pressure conduit 68 until the vane has rotated to the first limit position **19*a*. At this point the sensor 30 will again cause the switching valves 28 and 62 to cause a reversal in the position of the valve element back to the position shown in FIG. 1, and to cause clockwise rotation of the vane as seen in FIG. 2. In a manner similar to that described above, the material previously drawn into the cavity 14 will be forced through the first cavity opening 42 through the outlet 48 and into pressure conduit 68, while new material is drawn into the cavity 14 through the inlet opening 46 and second opening 44. Also as noted above, the reversal of the vane may take place while the openings 42 and 44** are sealed to maintain a constant pressure.

The halt of rotation of the vane upon encountering a pressure equal to that applied by the vane provide an additional advantage to the present invention. Specifically, when there are stoppages within the pressure conduit 68 due to blockage, downstream equipment failure or other reasons the present invention automatically halts its own operation. In such a situation the pressurized material within conduit 68 ceases to move, such that continued rotation of the vane 18, pushing additional material through one of the openings 42 or 44 and the opening 48, will serve to increase the pressure within the conduit 68. However, any incremental increase in the pressure of conduit 68 will be transferred through such openings to the vane 18 and thus motor 22. Therefore, the motor 22 will not be able to overcome such pressure when properly adjusted, and advance of the vane 18 will cease. This will allow the material within conduit 68 to be held within a pressurized, yet unconveyed condition.

Once the flow through conduit 68 is reestablished, the pressure will undergo an incremental drop, such that the motor 22 will automatically have sufficient pressure to begin further advance of vane 18. As may be readily seen, with this arrangement there is no need to provide a control system for the pump 10 to shut down operation of the pump where there has been a stoppage in material flow through conduit 68. All that is required is the proper adjustment of the supply pressure to the motor 22 such that the vane 18 will generate a pressure incrementally greater than that desired in conduit 68.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A pump for conveying fluid material, comprising:

a casing defining an interior cavity;

a vane having an at least substantially fluid tight seal with said cavity, said vane partitioning said interior cavity into a first and a second subcavity, said vane being mounted for movement within said cavity between a first limit position and a second limit position;

means for moving said vane within said cavity from said first to said second limit position and from said second to said first limit position;

a main valve assembly having a first cavity opening communicating with said first subcavity, a second cavity opening communicating with said second subcavity, an inlet opening, an outlet opening, and a valve element movable between a first position in which said inlet opening communicates with said first cavity opening and said outlet opening communicates with said second cavity opening and a second position in which said inlet opening communicates with said second cavity opening and said outlet opening communicates with said first cavity opening;

means for moving said valve element from said first to said second position and from said second to said first position; and control means for activating said valve moving means when said vane reaches said limit positions.

2. A pump as in claim 1, wherein said interior cavity has a substantially circular periphery defining a longitudinal axis perpendicular thereto, said vane extends radially from said axis, and said means for moving said vane comprises means for oscillating said vane about said axis.

3. A pump as in claim 2, wherein said vane oscillates through an angle of less than 360°, and wherein said valve assembly is located peripherally intermediate said limit positions.

4. A pump as in claim 3, wherein said valve element seals said first and second opening during movement between said first and second positions, whereby said first and second opening do not communicate during operation.

5. A pump as in claim 4, wherein said valve assembly includes a valve chamber having a substantially spherical interior wall through which said openings extend, and wherein said valve element has a periphery in the form of a portion of a sphere.

6. A pump as in claim 2, wherein said means for oscillating said pump comprises an hydraulic motor and means for supplying pressurized hydraulic fluid to said motor.

7. A pump as in claim 6, wherein said means for supplying fluid is set at a pressure such that the pressure developed by said vane is incrementally greater than a desired pump output pressure.

8. A pump for conveying fluid material, comprising:

a casing defining an interior cavity, said interior cavity having a substantially circular periphery defining a longitudinal axis perpendicular thereto;

a vane having an at least substantially fluid tight seal with said cavity, said vane partitioning said interior cavity into a first and a second subcavity, said vane extending radially of said axis and being mounted for oscillation within said cavity between a first limit position and a second limit position;

an hydraulic motor, and means for supplying pressurized hydraulic fluid to said motor, directly connected to said vane for moving said vane within said cavity from said first to said second limit position and from said second to said first limit position;

a main valve assembly having a first cavity opening communicating with said first subcavity, a second cavity opening communicating with said second subcavity, an inlet opening, an outlet opening, and a valve element movable between a first position in which said inlet opening communicates with said second cavity opening and a second position in which said inlet opening communicates with said second cavity opening and said outlet opening communicates with said first cavity opening;

means for moving said valve element from said first to said second position and from said second to said first position; and control means for activating said valve moving means when said vane reaches said limit positions.

9. A pump as in claim 8, wherein said valve assembly includes a valve chamber having a substantially spherical interior wall through which said openings extend, and wherein said valve element has a periphery in the form of a portion of a sphere, and further includes seal elements to provide an at least substantially fluid-tight seal between said valve element and said valve chamber.

10. A pump as in claim 9, wherein said means for supplying fluid is set at a pressure such that the pressure developed by said vane is incrementally greater than a desired pump output pressure, such that a blockage of the output of said pump causes an incremental increase of pressure in the output, thereby causing said vane to cease movement yet maintaining the output under said pressure.

* * * * *